US006460799B1

(12) United States Patent
Ryan

(10) Patent No.: US 6,460,799 B1
(45) Date of Patent: Oct. 8, 2002

(54) TOILET PAPER HOLDING DEVICE

(76) Inventor: Richard T. Ryan, 1994 Jackson St., San Francisco, CA (US) 94109

( * ) Notice: Subject to any disclaimer, the term of this patent is extended or adjusted under 35 U.S.C. 154(b) by 0 days.

(21) Appl. No.: 10/071,659

(22) Filed: Feb. 8, 2002

(51) Int. Cl.[7] ..... B65H 16/02

(52) U.S. Cl. ..... 242/594.5; 242/560.2; 242/598.5; 242/599; 242/599.2; D6/520

(58) Field of Search ..... 242/594.2, 594, 242/594.4, 594.6, 598.4, 598.5, 599.2, 560, 560.2; D6/520; 248/309.2, 905

(56) References Cited

U.S. PATENT DOCUMENTS

| | | | | | |
|---|---|---|---|---|---|
| 462,310 | A | * | 11/1891 | Gardner | 242/598.5 |
| 833,238 | A | * | 10/1906 | Pitschke | 242/598.5 |
| 2,685,365 | A | * | 8/1954 | Sieven | 242/560 |
| 2,790,608 | A | * | 4/1957 | Sieven | 242/560 |
| 3,297,265 | A | | 1/1967 | Turro | |
| 3,830,198 | A | | 8/1974 | Boone | |
| D252,842 | S | | 9/1979 | McKee | |
| 4,385,733 | A | | 5/1983 | O'Keefe | |
| 4,427,159 | A | | 1/1984 | Miller et al. | |
| 4,834,316 | A | * | 5/1989 | DeLorean | 242/594 |
| 5,012,986 | A | | 5/1991 | Needle | |
| D356,225 | S | * | 3/1995 | Coggins et al. | D6/520 |
| 5,605,250 | A | * | 2/1997 | Meiron et al. | 242/594.5 |
| 5,897,074 | A | * | 4/1999 | Marino | 242/594.5 |
| D452,094 | S | * | 12/2001 | Akin | D6/520 |

* cited by examiner

*Primary Examiner*—William A. Rivera

(57) ABSTRACT

A toilet paper holding device for releasably securing a spare roll of toilet paper to a spindle includes a tubular member is which elongated and has a first end and a second end. The tubular member has a pair of apertures extending therethrough. Each of the apertures is positioned adjacent to one of the first and second ends.

6 Claims, 2 Drawing Sheets

TOILET PAPER HOLDING DEVICE

BACKGROUND OF THE INVENTION

1. Field of the Invention

The present invention relates to toilet paper holders and more particularly pertains to a new toilet paper holding device for releasably securing a spare roll of toilet paper to a spindle.

2. Description of the Prior Art

The use of toilet paper holders is known in the prior art. While these devices fulfill their respective, particular objectives and requirements, the need remains for a device that holds a spare roll of toilet paper to an existing toilet paper dispenser/holder.

SUMMARY OF THE INVENTION

The present invention meets the needs presented above by providing a tubular member which holds a roll of toilet paper and is removably attachable to a spindle.

To this end, the present invention generally comprises a tubular member is which elongated and has a first end and a second end. The tubular member has a pair of apertures extending therethrough. Each of the apertures is positioned adjacent to one of the first and second ends. Each of a pair of tethers has an upper end and a lower end. The lower ends are removably extendable through one of the apertures such that the tethers are attached to the tubular member. A securing means attached to the upper ends for releasably securing the tethers to a spindle. The tubular member may be extended through a roll of toilet paper.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
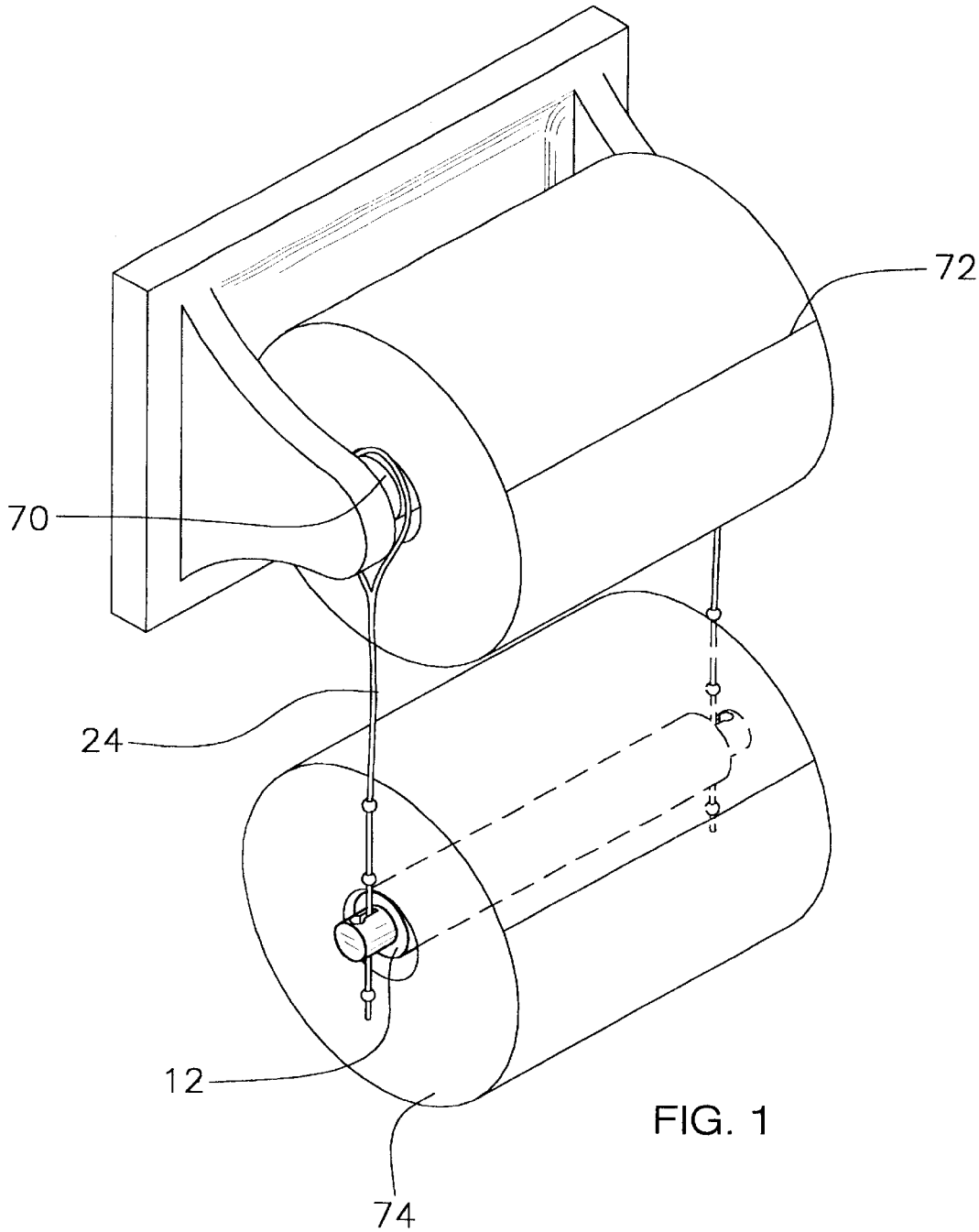
FIG. 1 is a schematic perspective view of a new toilet paper holding device according to the present invention.
Figure 2:
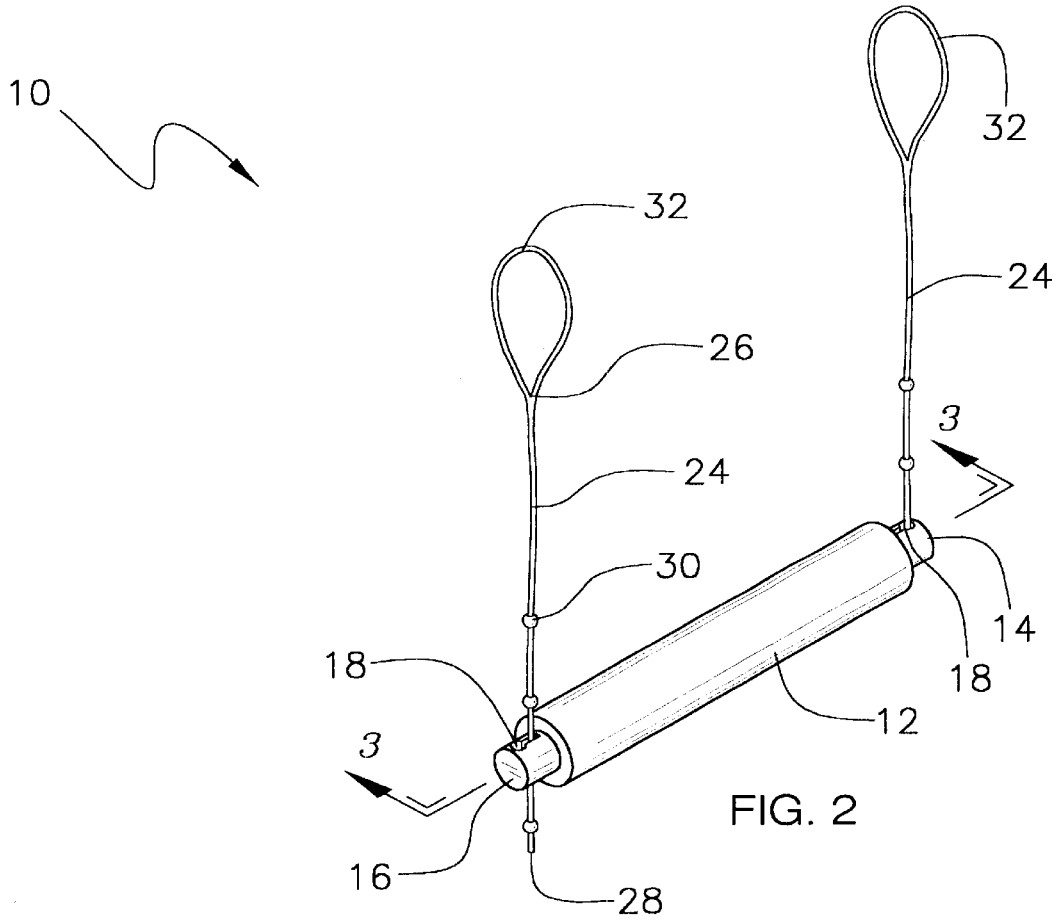
FIG. 2 is a schematic perspective view of the present invention.
Figure 3:
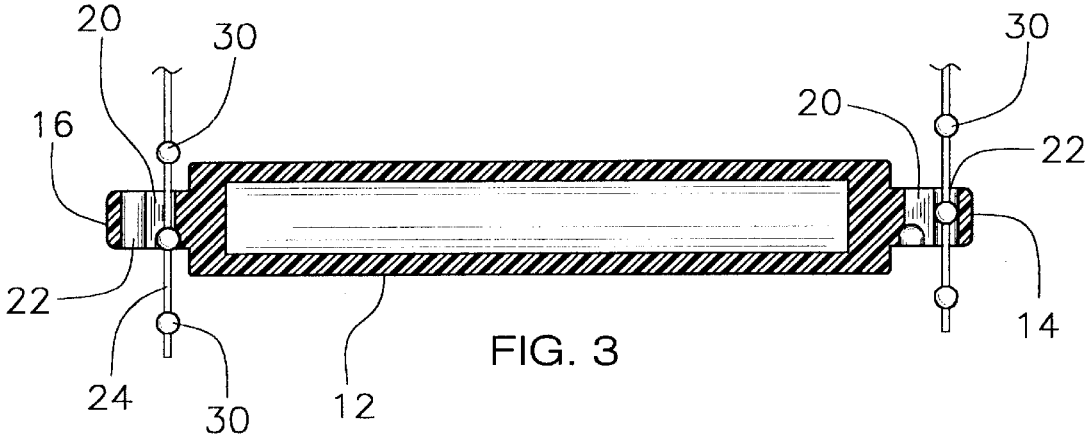
FIG. 3 is a schematic cross-sectional view taken along line 3—3 of FIG. 2 of the present invention.

With reference now to the drawings, and in particular to FIGS. 1 through 3 thereof, a new toilet paper holding device embodying the principles and concepts of the present invention and generally designated by the reference numeral 10 will be described.

As best illustrated in FIGS. 1 through 3, the toilet paper holding device 10 generally comprises a tubular member 12 which is elongated and has a first end 14 and a second end 16. The tubular member 12 has a pair of apertures 18 extending therethrough. Each of the apertures 18 is positioned adjacent to one of the first 14 and second 16 ends. Each of the apertures 18 is orientated generally perpendicular to a longitudinal axis of the tubular member 12 and orientated generally parallel to each other. The apertures 18 each have a distal portion 20 and a proximal portion 22 with respect to an adjacent one of the first 14 and second 16 ends. The proximal portions 22 are bulbous with respect to the distal portions 20.

Each of a pair of tethers 24 has an upper end 26 and a lower end 28. The lower ends 28 are removably extendable through one of the apertures 18 such that the tethers 24 are attached to the tubular member 12. A plurality of beads 30 is attached to each of the tethers 24. The beads 30 are spaced from each other. The beads 30 are extendable through the proximal portions 22 such that a portion of the tethers 24 positioned between adjacent beads 30 may be placed in the proximate portions 22. The beads 30 are larger than the distal portions 20 so that the beads 30 keep the tethers 24 in the apertures 18.

A securing means 32 is attached to the upper ends 26 for releasably securing the tethers 24 to a spindle 70. The securing means 32 preferably comprises a loop.

In use, the tubular member 12 may be extended through a roll of toilet paper 72. The tethers 24 are secured to the tubular member 12 and the loops, or securing means 32, are positioned around the spindle 70. The spindle 70 is a conventional spindle for holding a roll of toilet paper 72. In this manner, the tubular member 12 holds a second roll of toilet paper 74 and is easily retrofitted to existing toilet paper dispensing devices.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet paper holding device to removably attach a roll of toilet paper to a toilet paper spindle, said device comprising:

a tubular member being elongated and having a first end and a second end, said tubular member having a pair of apertures extending therethrough, each of said apertures being positioned adjacent to one of said first and second ends;

a pair of tethers, each of said tethers having an upper end and a lower end, each of said lower ends being removably extendable through one of said apertures such that said tethers are attached to said tubular member;

a securing means attached to said upper ends for releasably securing said tethers to the spindle;

wherein said tubular member may be extended through a roll of toilet paper; and.

each of said apertures having a distal portion and a proximal portion with respect to an adjacent one of said first and second ends, each of said proximal portions being bulbous with respect to said distal portions, a plurality of beads being attached to each of said tethers, said beads being spaced from each other, said beads being extendable through said proximal portions such that a portion of said tethers positioned between adjacent beads may be placed in said proximate portions.

2. The toilet paper holding device as in claim 1, wherein said securing means comprises a loop.

3. The toilet paper holding device as in claim 2, wherein each of said apertures is orientated generally perpendicular to a longitudinal axis of said tubular member.

4. The toilet paper holding device as in claim 1, wherein said securing means comprises a loop.

5. The toilet paper holding device as in claim 1, wherein each of said apertures is oriented generally perpendicular to a longitudinal axis of said tubular member.

6. A toilet paper holding device to removably attach a roll of toilet paper to a toilet paper spindle, said device comprising:

a tubular member being elongated and having a first end and a second end, said tubular member having a pair of apertures extending therethrough, each of said apertures being positioned adjacent to one of said first and second ends, each of said apertures being oriented generally perpendicular to a longitudinal axis of said tubular member and orientated generally parallel to each other, each of said apertures having a distal portion and a proximal portion with respect to an adjacent one of said first and second ends, each of said proximal portions being bulbous with respect to said distal portions;

a pair of tethers, each of said tethers having an upper end and a lower end, each of said lower ends being removably extendable through one of said apertures such that said tethers are attached to said tubular member, a plurality of beads being attached to each of said tethers, said beads being spaced from each other, said beads being extendable through said proximal portions such that a portion of said tethers positioned between adjacent beads may be placed in said proximate portions;

a securing means attached to said upper ends for releasably securing said tethers to the spindle, said securing means comprising a loop; and wherein said tubular member may be extended through a roll of toilet paper.

* * * * *